US008525058B2

(12) United States Patent
Hill et al.

(10) Patent No.: US 8,525,058 B2
(45) Date of Patent: Sep. 3, 2013

(54) SNORKEL FOR VENTING A DOME SWITCH

(75) Inventors: Matthew Hill, Mountain View, CA (US); Stephen Zadesky, Portola Valley, CA (US); Erik Wang, Redwood City, CA (US); Adam Mittleman, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 335 days.

(21) Appl. No.: 12/893,713

(22) Filed: Sep. 29, 2010

(65) Prior Publication Data

US 2011/0214977 A1 Sep. 8, 2011

Related U.S. Application Data

(60) Provisional application No. 61/310,917, filed on Mar. 5, 2010.

(51) Int. Cl.
*H01H 1/10* (2006.01)

(52) U.S. Cl.
USPC ..... 200/512; 200/516

(58) Field of Classification Search
USPC ..... 200/512–517
See application file for complete search history.

(56) References Cited

U.S. PATENT DOCUMENTS 4,972,394 A 11/1990 DiMarco
6,548,779 B2 * 4/2003 Takahashi et al. ..... 200/516
6,603,086 B2 * 8/2003 Kawaguchi et al. ..... 200/517
6,946,611 B2 9/2005 Yoneyama
6,982,394 B2 1/2006 Ide et al.
7,902,474 B2 * 3/2011 Mittleman et al. ..... 200/516
7,978,467 B2 7/2011 Ichikawa
2010/0046179 A1 2/2010 Arita
2010/0213044 A1 * 8/2010 Strittmatter et al. ..... 200/515

FOREIGN PATENT DOCUMENTS

WO 2008085130 A1 7/2008
WO 2010011199 A1 1/2010

* cited by examiner

*Primary Examiner* — Amy Cohen Johnson
*Assistant Examiner* — Marina Fishman
(74) *Attorney, Agent, or Firm* — Dorsey & Whitney LLP

(57) ABSTRACT

To prevent debris from entering the volume between a dome and contacts of a dome switch, a dome can include a channel providing a remote path through which air can be vented. In particular, the channel can extend from the dome to a location within an electronic device that is known to be or expected to be contaminant free (e.g., a region of the device that does not include any interfaces communicating with the device environment). The channel can be defined from components of the dome switch including, for example, as a channel bound by spacer walls between a flex circuit and a film layer. The channel can include an opening for venting the dome switch. In some embodiments, the dome switch can include a protective film applied over the opening in the channel. The protective film can be selected to allow air to flow through, but to prevent contaminants or particles from reaching the channel opening.

21 Claims, 7 Drawing Sheets

SNORKEL FOR VENTING A DOME SWITCH

CROSS-REFERENCE TO RELATED APPLICATION

This application claims the benefit of previously filed U.S. Provisional Patent Application No. 61/310,917, filed Mar. 5, 2010, which is incorporated by reference herein in its entirety.

BACKGROUND OF THE INVENTION

Users can provide inputs to electronic devices using many different approaches. For example, an electronic device can include different input interfaces by which a user can interact with the device. The input interfaces can include, for example, one or more switches, buttons, actuators, or sensors (e.g., touch sensors), the actuation of which the device can detect. In some cases, an electronic device can include a dome switch, which can be depressed to provide a detectable input. The dome switch is typically constructed by placing a conductive dome over a contact pad on a circuit board. When the dome is pressed, the dome can invert such that an inner surface of the dome contacts the contact pad. The dome inversion also provides a tactile 'click' that enhances the user's interaction with the switch. To actuate the dome switch, a user typically presses a cosmetic piece placed over the dome. In response to the user pressing the cosmetic piece, the dome is in turn is depressed and comes into contact with the contact point.

A dome switch can enclose a volume of air between the inner surface of the dome and the circuit board to which the dome is mounted. When the dome is depressed, the air within the enclosed volume may need to be displaced so that the center of the dome can contact the circuit board contact pad. To displace the air, a coversheet placed over the dome can include openings connecting the interior volume to the environment in which the dome switch is placed. When the dome is collapsed to close a circuit, air can be expelled from the internal volume through the openings, and remove an air pressure resistance to the dome movement. Air can re-enter the internal volume through the openings when the dome reverts to its initial position.

The openings in the dome coversheet, however, can provide a path for debris, water, or other external particles to enter the internal volume of the dome switch. If a conductive particle infiltrates the internal volume, the particle can cause corrosion or promote the formation of substances that prevent the proper operation of the switch. For example, particles can cause rust, oxidation, dendrite growth, or salt, sugar or chemical deposits. As another example, water can infiltrate the internal volume of the dome switch and short the switch.

SUMMARY OF THE INVENTION

A dome switch that includes a remote venting mechanism is provided. In particular, a dome switch can include a channel through which air can be vented out of the dome switch while preventing debris from migrating to underneath the dome.

A dome switch can enclose a volume of air between a dome and a flex circuit. The volume of air can be expelled from the volume when depressed to provide a responsive tactile effect. To prevent contaminants from entering the volume enclosed by the dome when the dome is actuated, the location and size of an opening connecting the volume within the dome to the dome environment can be selected such that the opening is away from the dome itself. In some embodiments, the dome switch can include a channel or tubular structure extending from the dome region and having an opening away from the dome through which air can flow.

The channel can be constructed as part of components of the dome switch. For example, the channel can be defined in a spacer positioned between a flex circuit and a film layer of the dome switch (e.g., a film covering the dome to retain the dome to the circuit board), where the spacer defines the channel sides. The distal end of the channel (e.g., the end away from the dome) can have an opening for venting air, which can be defined in any suitable component of the dome switch including, for example, in one or more of the circuit board, spacer, or film.

In some embodiments, a protective film can be placed over an opening of a dome switch. The protective film can include holes large enough to allow air to pass, but small enough to prevent contaminants (e.g., liquids or debris) from passing through the protective film. In some embodiments, the protective film can include a treatment or coating to enhance the film's ability to repel contaminants. For example, the protective film can include a hydrophobic coating.

BRIEF DESCRIPTION OF THE DRAWINGS

The above and other features of the present invention, its nature and various advantages will be more apparent upon consideration of the following detailed description, taken in conjunction with the accompanying drawings in which.

DETAILED DESCRIPTION

An electronic device can include several input interfaces for detecting inputs provided by a user including, for example, one or more buttons, switches, actuators, sensors, or combinations of these. In one implementation, an electronic device can include one or more dome switches that can be actuated to close a circuit. For example, an electronic device can include one or more dome switches associated with a device button (e.g., a home button or a key pad), a device housing, a region of a device housing, or combinations of these. In one implementation, a dome switch can be integrated within a device housing such that deformation of the device housing can cause the dome switch to invert at least partially and close a circuit in which the dome switch is integrated.

Figure 1:
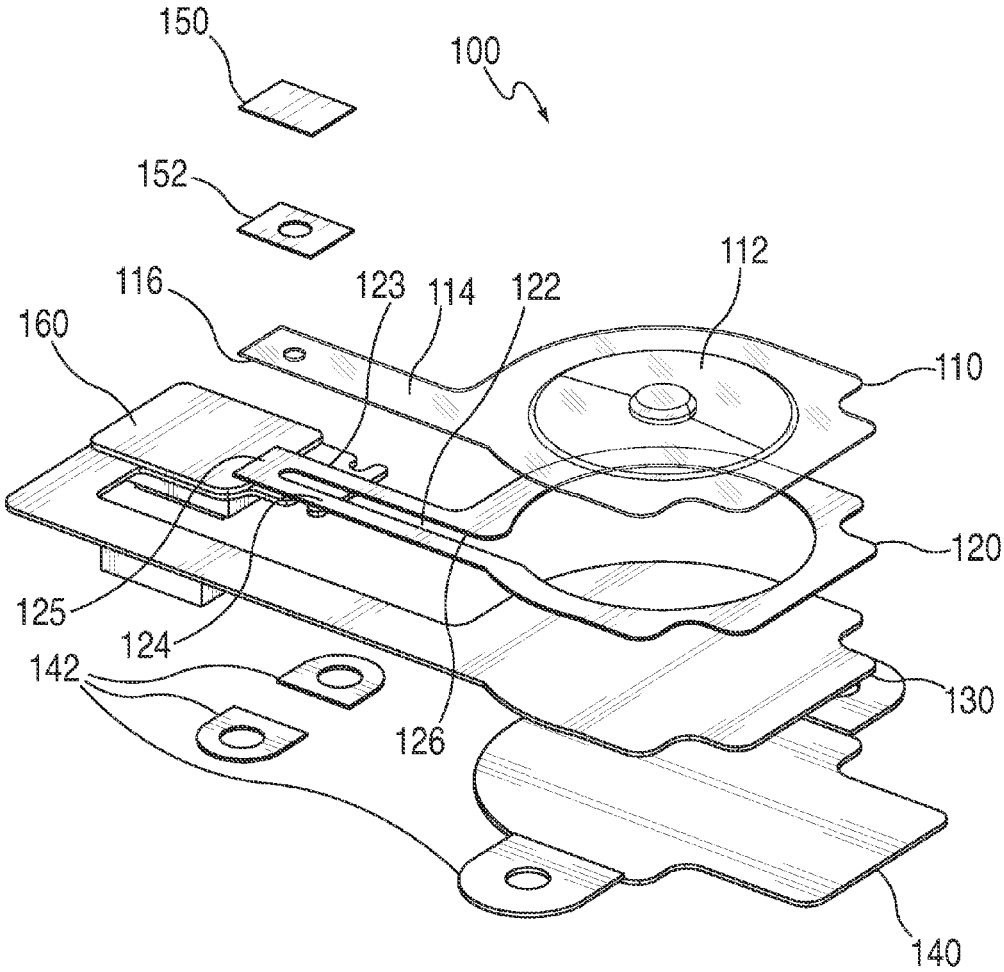
FIG. 1 is a schematic exploded view of an illustrative dome switch having a channel for venting in accordance with one embodiment of the invention.

FIG. 1 is a schematic exploded view of an illustrative dome switch having a channel for venting in accordance with one embodiment of the invention. Switch 100 can include dome 112 and film layer 110 placed over spacer 120, which in turn can be coupled to flex circuit 130. Film layer 110 can provide an impermeable seal around portions of switch 100. For example, film layer 110 can include an adhesive applied to one surface of the film layer, such that the adhesive can adhere the film layer to the spacer and trap dome 112 between the film layer and the flex circuit. It will be understood, however, that spacer 120 may not be necessary, and that a single layer of adhesive can instead or in addition be placed on the circuit to adhere to the dome or to the film layer. Flex circuit 130 can provide a support structure for receiving dome 112. In some embodiments, flex circuit 130 can include one or more components for providing an electrically conductive path between the flex circuit and the dome. For example, flex circuit 130 can include one or more exposed conductive pads to be put into contact with one or more regions of dome 112. The one or more exposed pads can be electrically isolated such that a circuit including the pads remains open unless the dome is at least partially inverted and connects the pads.

In some embodiments, dome switch 100 can include release liner 140 that can serve to assemble the components of dome switch 100 and to secure dome switch 100 within an electronic device. Release liner 140 can include one or more layers of adhesive to connect a portion of dome switch 100 to the electronic device. For example, release liner 140 can include a layer of adhesive (e.g., a glue layer), a tape layer (e.g., double sided tape), or a layer of adhesive coupled to a sheet. Release liner 140 can include alignment tabs 142 for ensuring a proper placement of the switch. The alignment tabs can include one or more targeting features including, for example, one or more holes to be aligned with corresponding features of an electronic device component on which dome switch 100 is placed.

Dome 112 can be constructed such that at least an inner surface of the dome (e.g., a concave surface of the dome) includes a conductive path. For example, dome 112 can be constructed from a conductive material (e.g., sheet metal) or a non-conductive material having an inner conductive surface (e.g., a plastic material with a conductive coating applied to the inner surface of the dome). Layer 110 can extend beyond the periphery of dome 112 by any suitable amount. In one implementation, layer 110 can extend beyond dome 112 by at least a minimum amount for ensuring a hermetic seal between dome 112 and flex circuit 130 (e.g., via an adhesive applied to layer 110 and connecting the layer to the flex circuit). This seal may be important, for example, to prevent debris or liquids from entering the space enclosed by dome 112. In some embodiments, in some regions, layer 110 can extend beyond dome 112 by an amount far exceeding the minimum amount required for ensuring a seal. For example, layer 110 can include extension 114 forming an arm extending from the periphery of dome 112. In some embodiments, the size, position and shape of extension 114 can be determined from the size, position and shape of another component of dome switch 100. For example, extension 114 can be selected to match channel 122 of spacer 120, or to match the shape of flex circuit 130.

Spacer 120 can be placed between layer 110 and flex circuit 130 to create a gap around the periphery of dome 112. Spacer 120 can have any suitable shape including, for example, a portion having cutouts or other features for receiving other elements of the dome switch. For example, a portion of spacer 120 positioned near dome 112 can include an opening in which dome 112 can lie. The opening can be sized to be larger than the dome, such that there may be free space around the dome. The free space can be used to direct air from within the dome switch out from underneath the dome when the dome is actuated. In some embodiments, the spacer can be positioned around the dome to serve as a barrier preventing debris, particles or liquid from seeping underneath dome 112 and into the volume enclosed between the dome and the circuit (e.g., where an electrical contact occurs). In some embodiments, spacer 120 may not extend around the entirety of the periphery of dome 112. Instead, spacer 120 can be limited to a portion of flex circuit 130 that extends away from the dome (e.g., the spacer is only used to define channel 122, described below).

Spacer 120 can have any suitable size. For example, spacer 120 can have a small thickness (e.g., 0.1 mm), a large thickness (e.g., (0.5 mm), or a variable thickness. The thickness of the spacer can be selected such that dome 112 can be inverted and connect with contact pads of circuit 130 without the spacer adversely affecting the operation of the dome. In particular, the thickness of the spacer can be at most equal to the height of the dome.

Spacer 120 can be secured between layer 110 and flex circuit 130 using any suitable approach. For example, an adhesive, mechanical connector, hook and fastener material, tape, or combinations of these can be used couple the spacer to one or both of the layer and flex circuit. In one implementation, spacer 120 can include adhesive applied to one or both surfaces of the spacer to couple the spacer to the flex circuit and layer. In an alternative approach, a piece of double sided tape can be used to couple the spacer to one or both of the layer and flex circuit.

Because air is expelled from dome switch 100 when dome 112 is at least partially inverted (e.g., the air enclosed in the volume between dome 112 and flex circuit 130 must be expelled to maintain a crisp tactile feedback), a path can be provided for the air to escape the dome to the device environment. To distance the opening at which air enters dome switch 100 from the flex circuit contact pads and from the conductive interior surface of the dome, spacer 120 can include a portion having side walls placed apart from each other to define channel 122 extending from a region adjacent to dome 112 to a region away from dome 112. The channel can be in fluid communication with air underneath or around dome 112. Channel 122 can be positioned such that an open end of channel 122 is located in a portion of the electronic device that is known to have or likely to have clean air (e.g., air that does not include any contaminants or debris). For example, the open end of channel 122 can be placed in an internal region of a device that is away from openings, ports or interfaces of the device (e.g., away from buttons or openings for audio). In this manner, it can be unlikely that foreign contaminants will reach the open end of the channel and find their way to the dome.

Channel 122 can be delimited by side walls 123 and 124, which can be spaced apart to define a region into which air can flow out from underneath dome 112. Channel 122 can extend between distal channel end 125 and proximal channel end 126 (e.g., near dome 112). Channel 122 can have any suitable height including, for example, a height substantially equal to that of spacer 120 (e.g., when channel 122 is defined within the spacer). Channel 122 can have any suitable width including, for example, a width determined from the volume of air to expel from underneath dome 112. For example channel 122 can have a width in the range of 0.10 mm to 0.50 mm, such as 0.30 mm.

In some embodiments, a portion of layer 110 (e.g., extension 114) can serve as a top or upper boundary for channel 122, while flex circuit 130 can serve as a bottom or lower boundary. Alternatively, channel 122 can be defined in spacer 120 such that portions of the spacer form one or both of the top and bottom boundaries of the channel. By providing upper and lower boundaries coupled to side walls 123 and 124, air can be directed through proximal end 126 towards distal end 125 of the channel and away from dome 112. Once air has reached end 125 of channel 122, the air can escape from within dome switch 100. In one implementation, the air can escape through the top surface of the channel (e.g., through layer 110). For example, the tip of extension 114 corresponding to end 125 of channel 122 can include opening 116 in communication with the channel. Opening 116 can be in communication with an internal volume of an electronic device in which dome switch 100 is placed, such that when dome 112 is depressed, air can flow in or out of the volume enclosed by dome 112 and flex circuit 130 through channel 122 and opening 116. Opening 116 can have any suitable size including, for example, a size determined from the volume of air to expel from underneath dome 112 (e.g., a size similar to the width of channel 122).

Figure 2:
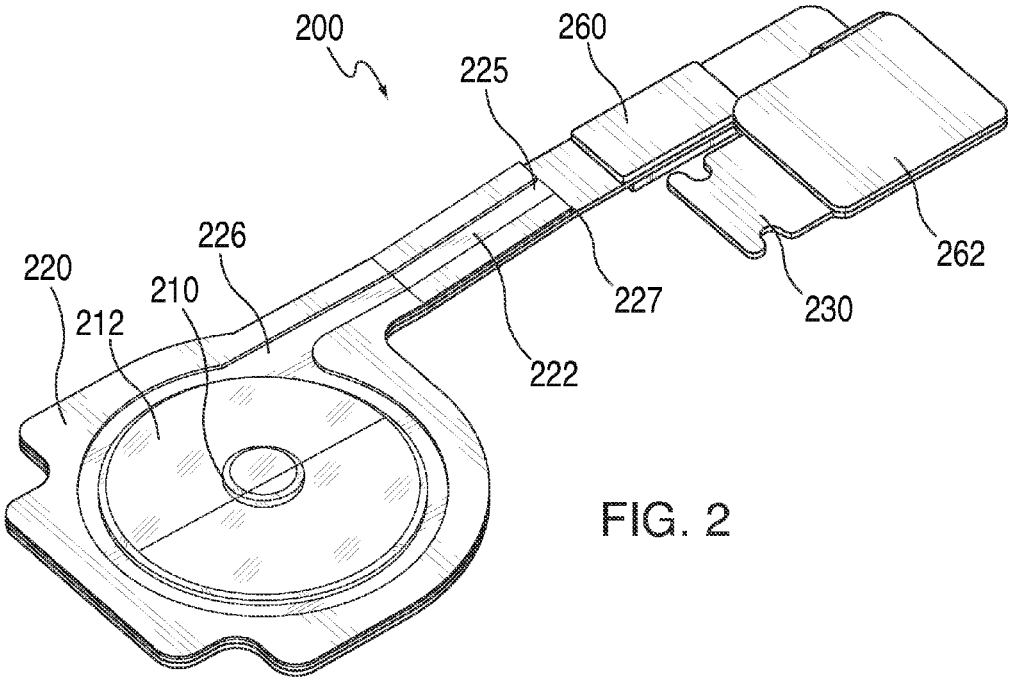
FIG. 2 is a schematic view of an illustrative dome switch having an open channel in accordance with one embodiment of the invention.

In some embodiments, the air can instead or in addition escape along the axis of the channel. FIG. 2 is a schematic view of an illustrative dome switch having an open channel in accordance with one embodiment of the invention. Dome switch 200 can include film layer 210, spacer 220, and flex circuit 230, each of which can include some or all of the features of the corresponding elements of dome switch 100 (FIG. 1). Spacer 220 can include channel 222 extending from proximal end 226 adjacent to dome 212 to distal end 225. To allow air to escape from the volume between dome 212 and flex circuit 230, channel 222 can include opening 227 through a wall of channel 222 near end 225. For example, opening 226 can extend along an axis of channel 222 (e.g., as a prolongation of channel 222). As another example, opening 227 can extend through a side wall of channel 222 (e.g., when end 225 of the channel is closed).

Opening 227 can have any suitable size relative to the width of channel 222. For example, opening 227 can have the same width as channel 222. As another example, opening 227 can include a larger opening than the width of channel 222 (e.g., a funnel-like shaped opening). As still another example, opening 227 can be smaller than the width of channel 222. The particular size of opening 227 and the width of channel 222 can be selected based on any suitable criteria including, for example, properties of the particular dome and flex circuit used for the dome switch (e.g., the size of the dome, the volume of internal air enclosed, or the travel of the dome when it is depressed).

Figure 3:
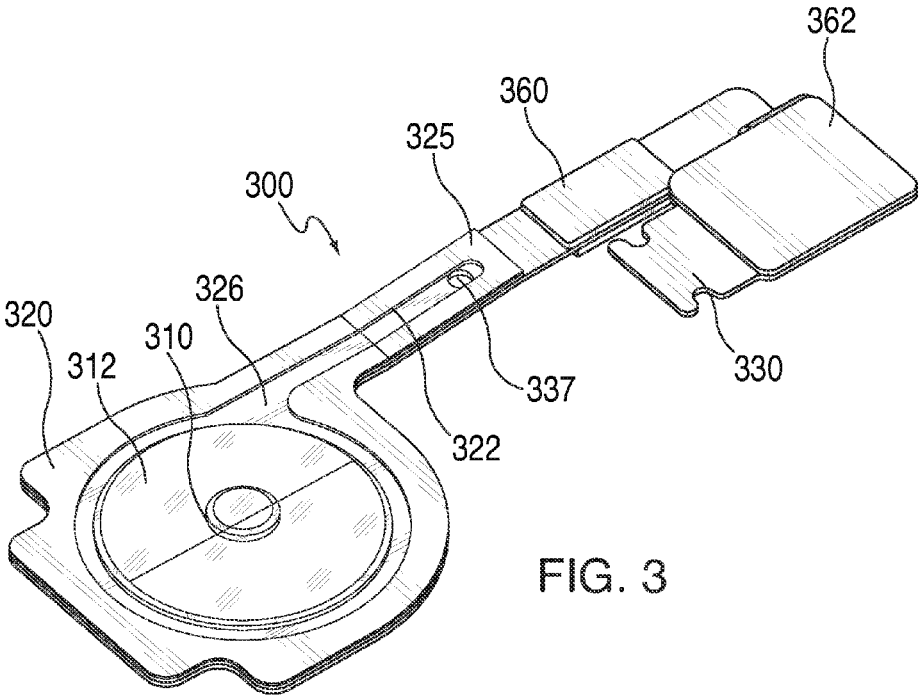
FIG. 3 is a schematic view of an illustrative dome switch having a channel with an open bottom surface in accordance with one embodiment of the invention.

In some embodiments, the air can instead or in addition escape through a bottom surface of the channel. FIG. 3 is a schematic view of an illustrative dome switch having a channel with an open bottom surface in accordance with one embodiment of the invention. Dome switch 300 can include film layer 310, spacer 320, and flex circuit 330, each of which can include some or all of the features of the corresponding elements of dome switch 100 (FIG. 1). Spacer 320 can include channel 322 extending from proximal end 326 near dome 312 to distal end 325. In particular, channel 322 can be defined by layer 310 serving as a top surface, flex circuit 330 serving as a bottom surface, and spacer 320 forming side walls and end 325 of the channel. To allow air to escape from the volume between dome 312 and flex circuit 330, flex circuit 330 can include opening 337 in communication with channel 322 (e.g., with a portion of channel 322 adjacent to end 325). Opening 337 can extend through the thickness of flex circuit 330 such that air can escape from channel 322 into an internal volume of an electronic device in which dome switch 300 is installed. Opening 337 can have any suitable size including, for example, a size determined from the volume of air to expel from underneath dome 312 (e.g., a size substantially matching the width of channel 322).

Although the channels of FIGS. 1-3 were shown as substantially straight channels extending from the dome, it will be understood that the channels can have any suitable shape, or follow any suitable path (e.g., a curved channel extending from the dome). In some embodiments, the shape or path of a channel extending from a dome can be determined from the shape of a flex circuit, from the position of other components of the dome switch (e.g., other components or stiffeners coupled to the flex), or from the position of components of the electronic device in which the dome switch is placed. In some embodiments, a dome switch can include several channels extending in the same or different directions (e.g., two channels extending from a single region of the dome switch or toward a single region of the electronic device, or two channels extending in different directions). In some embodiments, a single channel can include several openings (e.g., a top opening and an end opening). The openings can be distributed along any suitable portion of the channel including, for example, near the dome (e.g., a small hole in the film layer), along the channel length (e.g., a hole in the side wall), and near the end of the channel (e.g., through the flex circuit). In some cases, the channel size (e.g., width and height) can vary based on the position and size of different openings in the channel.

A channel used to vent air from a dome switch can have any suitable length. In the examples of FIGS. 1-3, the channel extends along the length of the flex circuit until the channel reaches a stiffener (e.g., stiffener 160, 260, 262, 360 or 362). The stiffener can include a relatively rigid component coupled to the flex circuit in a region opposite one or more electrical components coupled to the flex (e.g., electrical components are soldered to a first surface of the flex, and the stiffener is coupled to the opposite surface of the flex to protect the interface between the component and the flex). The stiffener can have any suitable thickness including, for example, a thickness at least equal to or larger than the thickness of the spacer. This may prevent the channel from following the flex past the spacer.

Figure 4:
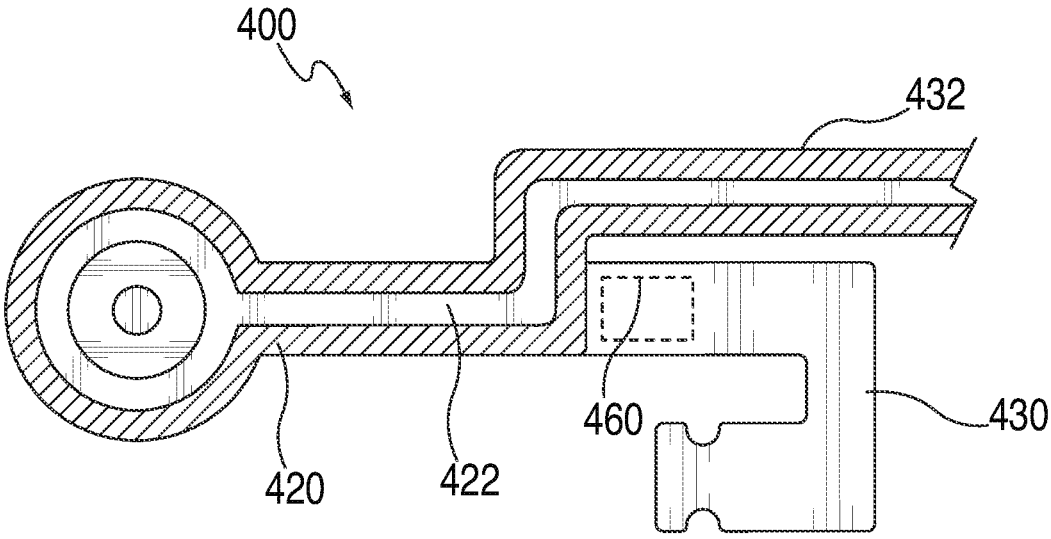
FIG. 4 is a schematic view of an illustrative dome switch having a flex extension for venting in accordance with one embodiment of the invention.

In some cases, however, it may be desirable to vent a dome switch in or through areas in the vicinity of the stiffener. Any suitable approach can be used to divert a channel away from or around a stiffener. In some cases, the channel can be partially or entirely separated from the flex circuit to provide an unobstructed path for venting the dome switch. FIG. 4 is a schematic view of an illustrative dome switch having a flex extension for venting in accordance with one embodiment of the invention. Dome switch 400 can include any of the features of dome switch 100 (FIG. 1), described above. Dome switch 400 can include flex circuit 430 providing contact pads for the dome switch, and supporting one or more electrical components (e.g., resistors). To protect the electrical components from damage caused by bending or displacing flex circuit 430, dome switch 400 can include stiffener 460 placed on flex circuit 430 opposite the electrical components. Spacer 420 can be placed over flex circuit 430 to provide channel 422 through which air can be expelled from underneath the dome. Because of stiffener 460, however, the length of channel 422 can be restricted.

In some embodiments, flex circuit 430 can include arm 432 extending around stiffener 460 and providing an alternate path for spacer 420 (e.g., a non-linear path or curved path). Arm 432 can include a conductive flex circuit section (e.g., if another electrical component is coupled to arm 432 at a further distance from the dome), or a non-conductive flex circuit section. Arm 432 can extend around stiffener 460 at any suitable distance from the dome. For example, arm 432 can extend directly from a portion of the flex circuit other than the portion of flex circuit 430 having stiffener 460. As another example, arm 432 can extend from the region of flex circuit 430 that is between the dome and stiffener 460. Arm 432 can have any suitable length including, for example, a length that exceeds the length of the other portions of flex circuit 430. Alternatively, arm 432 can form a bridge around stiffener 460 such that arm 432 reconnects with flex circuit 430 after the stiffener.

Channel 422 can extend along arm 432 in much the same way as channel 422 is formed on flex circuit 430. For example, spacer 420 can match the shape of arm 432, while a film layer can also match the shape of arm 432 and spacer 420. The spacer can adhere to both arm 432 and the film layer using any suitable approach including, for example, using one or more adhesives.

Figure 5:
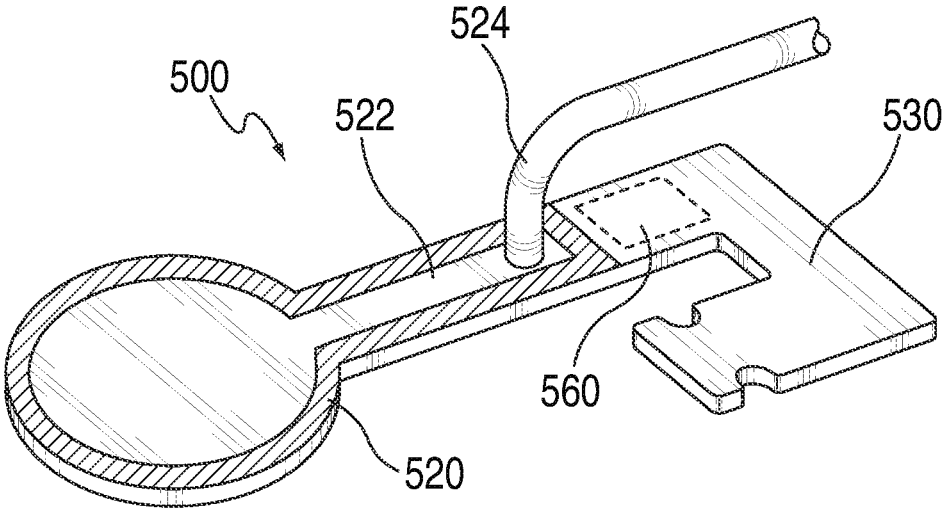
FIG. 5 is a schematic view of an illustrative dome switch having a tube connected to a channel in accordance with one embodiment of the invention.

In some embodiments, the channel can instead or in addition be coupled to a tube that directs the channel away from the flex. FIG. 5 is a schematic view of an illustrative dome switch having a tube connected to a channel in accordance with one embodiment of the invention. Dome switch 500 can include some or all of the features of dome switch 100 (FIG. 1). In particular, dome switch 500 can include flex circuit 530 having stiffener 560 limiting the range of spacer 520 that defines channel 522 for directing air expelled from the dome switch away from the dome. Instead of defining an additional flex circuit arm for extending the channel, as shown in FIG. 4, tube 524 can be coupled to channel 522. For example, an opening can be formed in one or more of a top, bottom or side surface of the channel (e.g., in a flex circuit, in a film layer, or in a side wall or end wall of the spacer) to which tube 524 can be connected. Tube 524 can be coupled to the opening in channel 522 using any suitable approach including, for example, an adhesive, tape, heat staking, a fastener, or combinations of these. In some embodiments, the coupling approach can be selected to provide a hermetic seal between channel 522 and tube 524. Tube 524 can extend from channel 522 to any suitable location. For example, tube 524 can extend to a portion of an electronic device having air likely to have no contaminants (e.g., a portion of the device away from openings or holes in the device housing). In some embodiments, tube 524 can have one or more openings for venting air from channel 522.

Tube 524 can have any suitable shape. For example, tube 524 can include a substantially circular or elliptical tube. Alternatively, tube 524 can include a polygonal or arbitrary cross-section, or a variable cross-section. The tube can have any suitable size (e.g., diameter) including, for example, a size that substantially corresponds to the size of channel 522 (e.g., a size that allows a consistent and smooth flow of air between channel 522 and tube 524).

Figure 6:
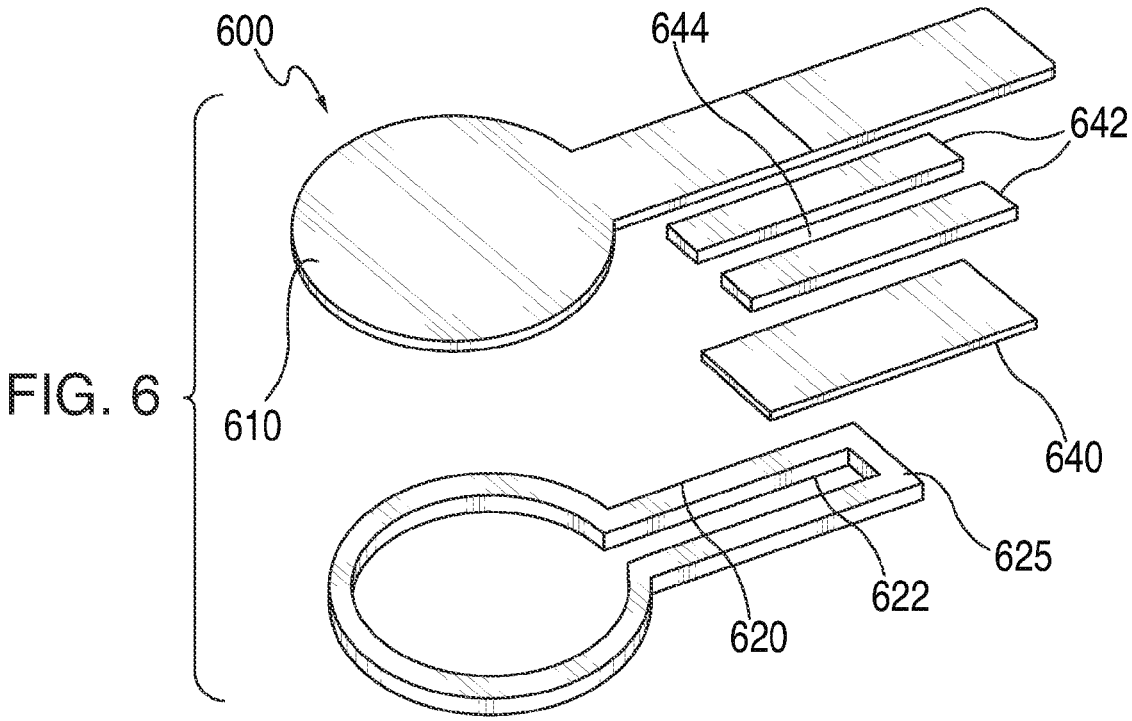
FIG. 6 is a schematic view of an illustrative dome switch having a step in accordance with one embodiment of the invention.

In some embodiments, the channel can be extended by changing the plane in which the channel lies. For example, another plane co-planar to the plane of the flex or co-planar to the plane that includes the periphery of the dome can be selected. In one implementation, the channel can include a step for passing over a stiffener. FIG. 6 is a schematic view of an illustrative dome switch having a step in accordance with one embodiment of the invention. Dome switch 600 can include some or all of the features of dome switch 100 (FIG. 1). In particular, dome switch 600 can include film layer 610 placed over spacer 620 that defines channel 622 having closed end 625 (e.g., closed end 625 can be required by a stiffener on a flex circuit). To extend channel 622 beyond closed end 625, dome switch 600 can include secondary sheet 640 and secondary spacer 642. Secondary sheet 640 can define a new bottom surface for channel 622, where the secondary sheet may not be at the same height as the flex circuit. For example, secondary sheet 640 can be placed over the stiffener. As another example, the stiffener can serve as secondary sheet 640. Secondary sheet 640 can be positioned such that its top surface is substantially aligned with the top surface of spacer 620 (and with the top surface of closed end 625).

To extend channel 622, secondary spacer 642 can be overlaid on secondary sheet 640 (and, in some cases, a portion of spacer 620, such as the portion of spacer 620 near end 625) to form a step in channel 622. Secondary spacer 642 can define secondary channel 644 stepped up from channel 622. Secondary channel 644 can have any suitable size including, for example, a size that is substantially the same as that of channel 622 (e.g., same height and width). In some embodiments, film 610 can have an initial opening near end 625 to vent some of the air expelled from the dome. This can enable secondary channel 644 to be smaller than channel 622.

Dome switch 600 can have any suitable number of channels at different levels. For example, dome switch 600 can include several increasing levels of channels. As another example, dome switch 600 can include several levels of channels that step up and down (e.g., a first channel at the level of channel 622, a second channel at the level of channel 644, and a third channel back at the level of channel 622). In some embodiments, each secondary spacer (e.g., secondary spacer 640) can include a tapered edge to ensure that film layer 610 can adhere to the spacers without undesired openings in the spacer-film layer interface.

Returning to FIG. 1, dome switch 100 can include protective film 150 coupled to film layer 110 via adhesive gasket 152. Protective film 150 can be placed over an opening of channel 122 such that the film can prevent the ingress of debris, liquid (e.g., water, sweat, alcohol, soda, coffee, tea, or milk), or other contaminants into the channel. In some embodiments, protective film can instead or in addition be placed over a vent incorporated in another portion of the dome switch (e.g., one or more vents of the dome). Adhesive gasket 152 can include an opening corresponding to an opening of the channel, such that air can flow from the channel to protective film 150.

Figure 7:
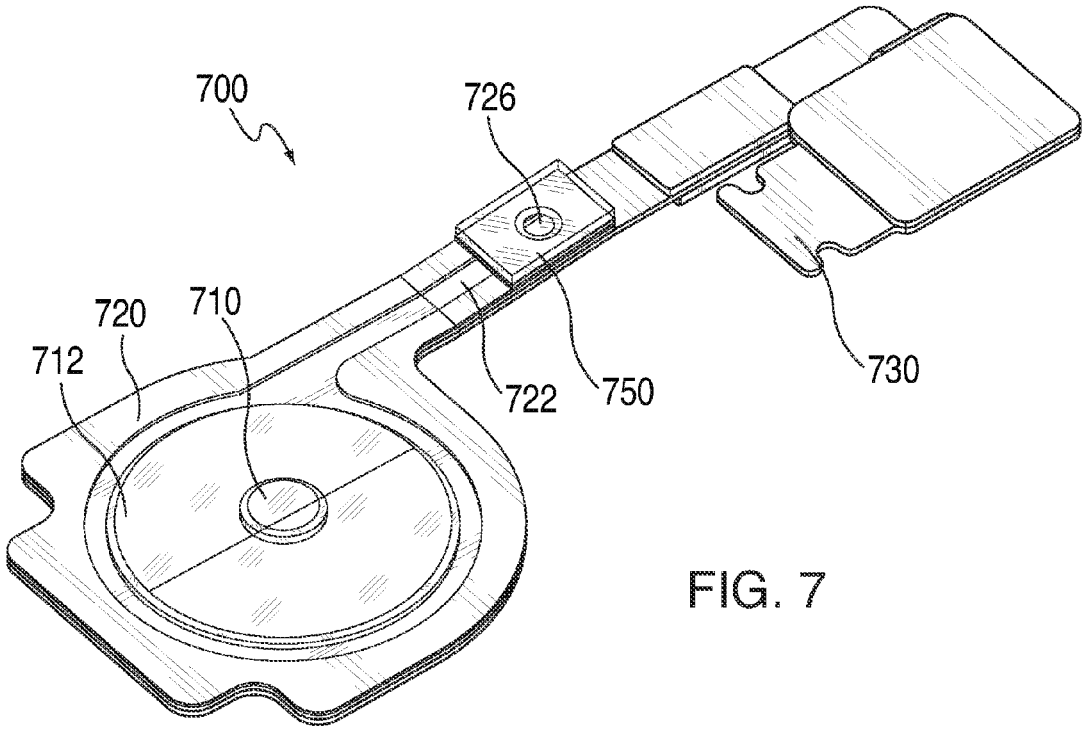
FIG. 7 is a schematic view of an illustrative dome switch having a protective film over a channel opening in accordance with one embodiment of the invention.

FIG. 7 is a schematic view of an illustrative dome switch having a protective film over a channel opening in accordance with one embodiment of the invention. Dome switch 700 can include some or all of the features of dome switch 100. In particular, dome switch 700 can include film layer 710 placed over spacer 720 and coupled to flex circuit 730. Spacer 720 can include channel 722 through which air enclosed between dome 712 and flex circuit 730 can be expelled when the dome is depressed. Channel 722 can include opening 726, shown to be in film layer 710 (though it will be understood that opening 726 can be in any suitable portion of dome switch 700) for communicating with the outside of dome switch 700. Protective film 750 can be placed over opening 726 to prevent foreign particles or contaminants from entering the enclosed volume of dome switch 700.

To allow air particles to pass through the protective film (e.g., as part of the dome actuation process) while preventing contaminants from passing into channel 722, protective film 750 can define a mesh having openings through which air can pass. The mesh can be treated to prevent non-air particles from passing through the mesh holds. For example, protective film 750 can include a hydrophobic, oleophobic, or other coating, or a chemical treatment selected for reducing permeability to particular elements. Protective film 750 can be constructed from any suitable material including, for example, plastic, a composite material, or expanded PFTE. The openings in the material (e.g., through which air can pass) can be uniform (e.g., a mesh defined by strands of material overlaid in a regular pattern) or arbitrary, as long as the openings are less than a maximum size selected to prevent particles or contaminants from entering the dome switch.

Figure 8:
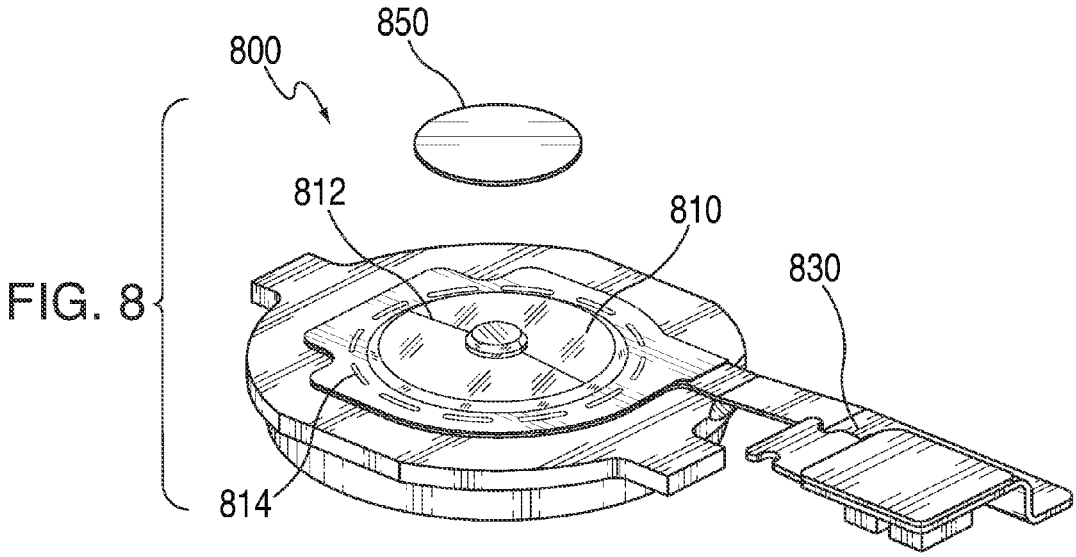
FIG. 8 is a schematic view of an illustrative dome switch having a protective mesh over vents adjacent to the dome in accordance with one embodiment of the invention.

FIG. 8 is a schematic view of an illustrative dome switch having a protective mesh over vents adjacent to the dome in accordance with one embodiment of the invention. Dome switch 800 can include film layer 810 placed over dome 812 and flex circuit 830. Film layer 810 can include vents 814 for allowing air to escape from underneath dome 812. To prevent contaminants from entering the dome switch through vents 814, protective film 850 can be applied over the vents. Protective film 850 can include a permeable mesh that allows air to be expelled from the dome while preventing liquids and other debris from reaching the dome and the flex circuit.

Although this discussion described the use of a channel and a protective film in the context of a dome switch, it will be understood that a channel and a protective film can be applied over any suitable electronic component, such as a pressure transducer, microphone, speaker, or other component requiring the displacement of a volume of air to operate. In some embodiments, a channel and a protective film can provide a closed path to a target volume of air or to an acoustic volume.

Figure 9:
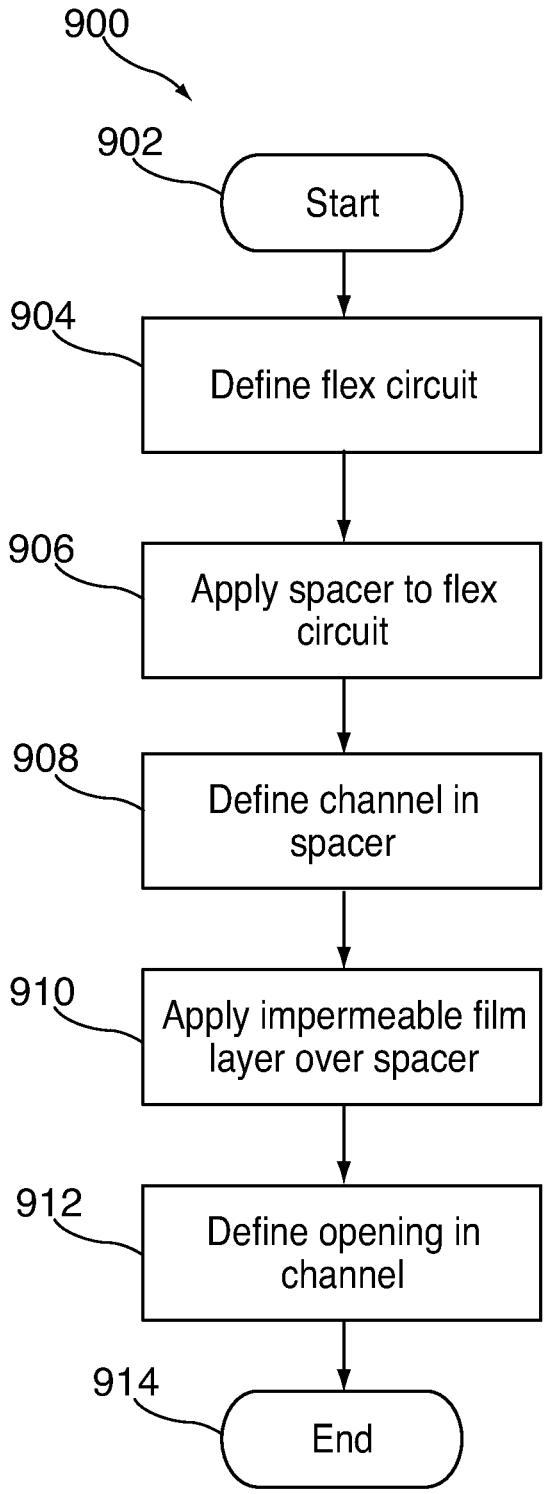
FIG. 9 is a flowchart of an illustrative process for constructing a dome switch having a channel for remote venting in accordance with one embodiment of the invention.

FIG. 9 is a flowchart of an illustrative process for constructing a dome switch having a channel for remote venting in accordance with one embodiment of the invention. Process 900 can begin at step 902. At step 904, a flex circuit can be defined. For example, a flex circuit having contact pads for a dome switch can be defined. In some embodiments, the flex circuit can include an extension that may form a portion of a channel used to remotely vent a dome switch. At step 906, a spacer can be applied to the flex circuit. The spacer can be coupled to the flex circuit using an adhesive, and define an external periphery for the dome switch. For example, the spacer can be provided around the periphery of the dome, and along side portions of a flex circuit extension to form the side walls of a channel. In some embodiments, the spacer can be formed from a double-sided adhesive. At step 908, a channel can be defined in the spacer. For example, a channel can be cut in the spacer layer. As another example, the channel can be defined as a portion between side walls of the spacer.

At step 910, an impermeable film layer can be applied over the spacer. For example, a plastic film can be adhered to the spacer. In some embodiments, the plastic film layer can be placed over a dome positioned on the flex circuit, or the plastic film can incorporate a dome. At step 912, an opening can be defined in the channel so that air from the volume between the dome and the flex circuit can be expelled from the dome through the channel when the dome is actuated. The opening can be provided in any suitable component of the dome switch including, for example, in the flex circuit, film layer, or in the spacer. In some embodiments, a channel can include several openings. In some cases, an addition protective layer can be placed over one or more of the openings to prevent contaminants from entering the channel while allowing air to pass through the protective layer. Process 900 can then end at step 914.

Figure 10:
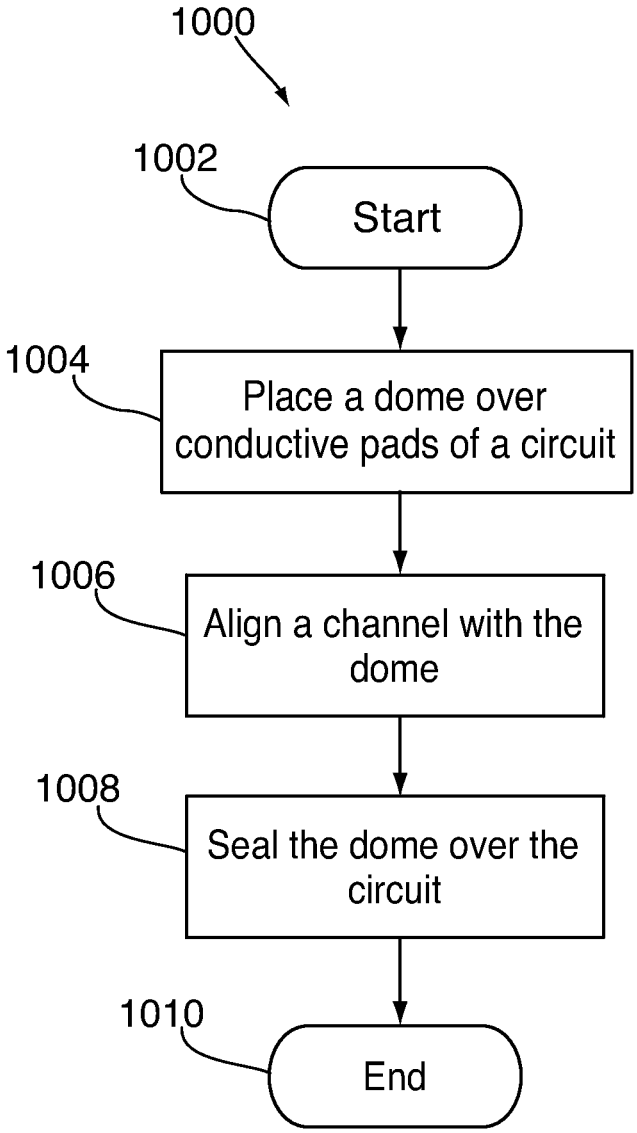
FIG. 10 is a flowchart of an illustrative process for providing a remotely venting dome switch in accordance with one embodiment of the invention.

FIG. 10 is a flowchart of an illustrative process for providing a remotely venting dome switch in accordance with one embodiment of the invention. Process 1000 can begin at step 1002. At step 1004, a dome can be placed over conductive pads of a circuit. For example, a dome can be placed over a circuit, such that a periphery of the dome is in contact with a first conductive pad, and the dome can come into contact with a second conductive pad when it is depressed and partially inverted. At step 1006, a channel can be aligned with the dome to provide a fluid communication between the channel and the dome. The channel can be constructed using different approaches including, for example, from free space between different spacer elements. The channel can include a proximal opening in the vicinity of the dome, and a distal opening away from the dome. At step 1008, the dome can be sealed over the circuit to prevent air from reaching underneath the dome except through the channel. For example, a film can be applied to the dome to hermetically seal the dome to the circuit. In some embodiments, the film can be applied over the spacer to provide a single path through the channel between the device environment and the dome. Process 1000 can then end at step 1010.

The above described embodiments of the present invention are presented for purposes of illustration and not of limitation, and the present invention is limited only by the claims which follow.

What is claimed is:

1. A dome switch comprising:

a dome;

a flex circuit comprising a dome region and an extension, the dome region being configured to receive the dome;

a stiffener attached to the flex circuit extension to provide structural support;

a first spacer attached to a surface of the flex circuit, wherein a first portion of the first spacer extends around a periphery of the dome and a second portion of the first spacer extends along at least a portion of the flex circuit extension, the second portion comprising side walls separated from one another and defining a gap;

a film layer applied over the first spacer and the dome, the film layer extending across the gap between the side walls to define a first channel providing a path for expelling air from under the dome when the dome is depressed, the first channel extending along a length of the extension to the stiffener;

at least one sheet between the first spacer and the film laver; and at least one additional spacer disposed between each sheet and the film laver, the at least one sheet, the at least one additional spacer, and the film layer forming at least one additional channel.

2. The dome switch of claim 1, wherein:

the first channel comprises a proximal end in fluid communication with the dome.

3. The dome switch of claim 1, wherein:

the first channel comprises a distal end having an opening for venting air out of the dome switch.

4. The dome switch of claim 3, wherein:

the opening is provided in one of the extension, the first spacer, and the film layer.

5. The dome switch of claim 3, further comprising:

a protective film placed over the opening to at least one of inhibit and prevent contaminants from entering the first channel.

6. The dome switch of claim 5, wherein:

the protective film comprises a mesh.

7. The dome switch of claim 1, wherein the flex circuit further comprises:

a first contact pad located in the dome region, wherein a portion of the periphery of the dome is electrically contactable with the first contact pad; and a second contact pad located in the dome region, and electrically isolated from the first contact pad, wherein an interior region of the dome is electrically contactable with the second contract pad in response to depression of the dome.

8. The dome switch of claim 1, wherein:

the first portion of the first spacer comprises an opening in fluid communication with the gap.

9. A dome switch, comprising:

a dome placed on a support structure, the dome being at least partially invertable to provide an electrically conductive path between first and second contact pads of the support structure;

a spacer defining a channel, the channel including a proximal opening defined therein, the proximal opening being in fluid communication with air trapped underneath the dome;

a tube extending from an opening in the spacer to vent air from underneath the dome; and a film over the dome and the proximal opening of the spacer, wherein the film forms a hermetic seal to at least one of inhibit and prevent air from reaching the dome other than through the channel.

10. The dome switch of claim 9, wherein:

the film prevents air from reaching underneath the dome except through the channel.

11. The dome switch of claim 9, wherein:

the support structure defines a bottom surface of the channel.

12. The dome switch of claim 9, wherein:

the film defines a top surface of the channel.

13. The dome switch of claim 9, wherein:

the tube extends to a region of an electronic device that is free from foreign particles.

14. The dome switch of claim 9, wherein the tube and the channel are attached to form a hermetic seal.

15. The dome switch of claim 9, wherein the tube is attached to the channel by at least one of adhesive tape, heat staking, and fastening.

16. A method for constructing a dome switch, comprising:

providing a dome over conductive pads of a circuit;

aligning a first channel constructed within a first spacer with the dome, a proximal end of the first channel being in fluid communication with air underneath the dome and the first channel extending along a length of the circuit to a stiffener;

aligning a second channel constructed within a second spacer to a distal end of the first channel, the second channel being at a different height than the first channel; and sealing the dome over the circuit to at least one of inhibit and prevent air from reaching underneath the dome other than through the first channel.

17. The method of claim 16, further comprising:

providing an opening in the first channel through which air expelled from underneath the dome can exit the dome switch; and applying a protective mesh over the opening to at least one of inhibit and prevent foreign particles from entering the first channel.

18. The method of claim 16, wherein aligning a first channel further comprises:

connecting a first spacer element to the circuit; and connecting a second spacer element to the circuit, wherein the first and second spacer elements are spaced apart from one another and define the first channel.

19. The method of claim 18, further comprising: applying a film over the first and second spacer elements to seal the first channel; and applying the film over the second channel to seal the second channel.

20. The method of claim 19, wherein sealing further comprises:

applying the film over the dome and a support structure to seal the dome to the support structure.

21. The method of claim 16, wherein the stiffener is attached to a portion of the circuit.

* * * * *